United States Patent [19]

Cuir et al.

[11] Patent Number: 4,632,381

[45] Date of Patent: Dec. 30, 1986

[54] PROCESS AND APPARATUS FOR TRANSFERRING A SHEET OF MATERIAL FROM ONE ASSEMBLY TO ANOTHER

[76] Inventors: Jean P. Cuir, 36 Av de Brigode; Gérard Cuir, 23 Allée des Champs, both of 59650 Villeneuve d'Ascq, France

[21] Appl. No.: 496,658

[22] Filed: May 20, 1983

[30] Foreign Application Priority Data

May 27, 1982 [FR] France ..... 8209704

[51] Int. Cl.[4] ..... B65H 5/34

[52] U.S. Cl. ..... 271/270; 271/96; 271/203

[58] Field of Search ..... 271/270, 276, 197, 202, 271/203, 5, 7, 94, 96

[56] References Cited

U.S. PATENT DOCUMENTS

| | | | |
|---|---|---|---|
| 2,052,310 | 8/1936 | Lifsitz | 271/270 |
| 2,670,955 | 3/1954 | Strecker | 271/76 |
| 2,852,256 | 9/1958 | Faulls | 271/76 |
| 3,048,393 | 8/1962 | Furr et al. | 271/34 |
| 3,735,976 | 5/1973 | Watson | 271/26 ES |
| 3,827,545 | 8/1974 | Bunayar | 271/203 |
| 4,096,941 | 6/1978 | Tokuno | 271/197 |
| 4,200,276 | 4/1980 | Marschke | 271/202 |

FOREIGN PATENT DOCUMENTS

| | | |
|---|---|---|
| 2124177 | 11/1972 | Fed. Rep. of Germany . |
| 2348881 | 11/1977 | France . |
| 2418186 | 9/1979 | France . |

*Primary Examiner*—Bruce H. Stoner, Jr.
*Assistant Examiner*—John A. Carroll
*Attorney, Agent, or Firm*—Kerkam, Stowell, Kondracki & Clarke

[57] ABSTRACT

The invention relates to a process and to an apparatus for transferring a sheet of material. The process is characterized in that:

at least two successive conveyors (11, 12) are connected, the second conveyor having a coefficient of adhesion which is higher than the first conveyor, and first, the speeds of said conveyors are adapted to the speed ($V_2$) prevailing on the sheet as it arrives on the first conveyors, and then, when the sheet covers the second conveyor with a portion deemed adequate, the speed of the second conveyor is modified until it attains the speed ($V_2$) at which the second conveyor is to deliver the sheet, and, finally, as soon as the sheet has let the second conveyor, the speed of the second conveyor is brought back to that of the first. The method and the apparatus for carrying out the method have particular application to printing and cutting machines.

8 Claims, 1 Drawing Figure

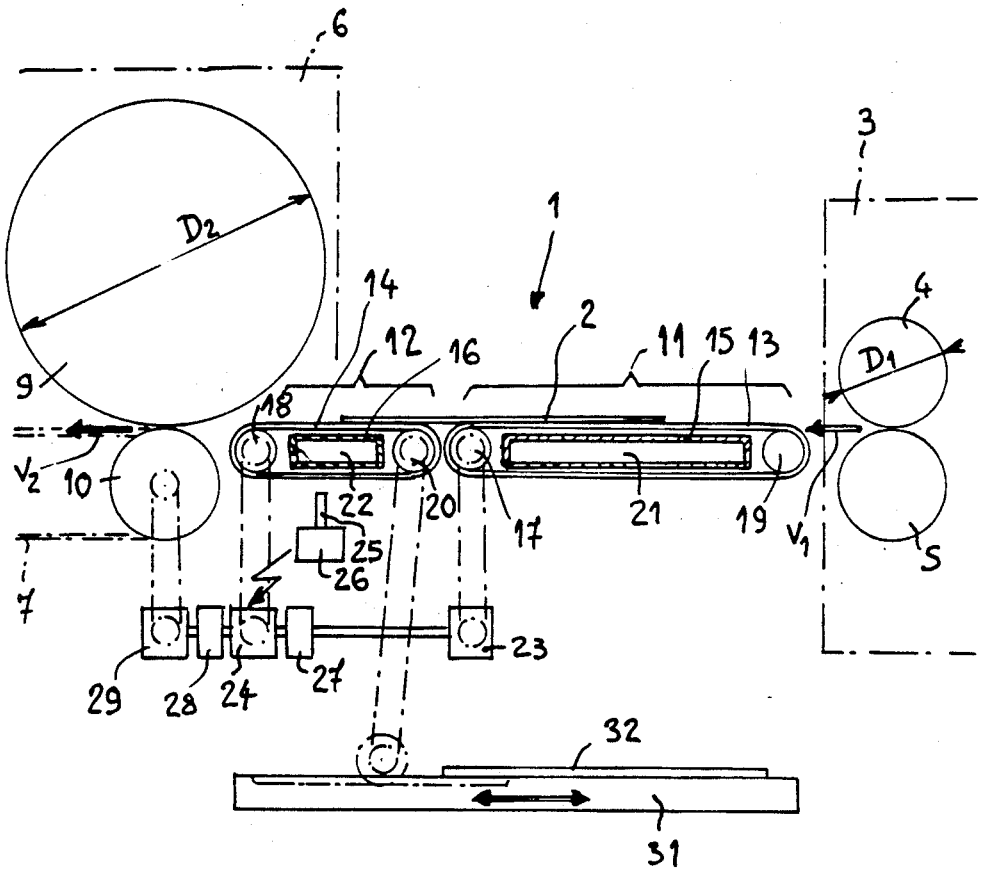
6
3
D2
1
14
12
16
2
11
15
13
4
D1
9
18
V2
10
22
20
17
21
19
V1
S
25
26
7
23
29
28
24
27
32
31

PROCESS AND APPARATUS FOR TRANSFERRING A SHEET OF MATERIAL FROM ONE ASSEMBLY TO ANOTHER

The invention relates to a process and an apparatus for transferring a sheet of material from one assembly to another, especially if the delivery of the sheet by the first assembly and the reception thereof by the second assembly are effected at different speeds.

More particularly, but not exclusively, it finds application in the transfer of sheets of paper or cardboard from a printing or cutting machine to another, even though in these machines the linear speeds may vary considerably and, moreover, the exact position of the sheet must be adhered to in order to obtain register between the two machines.

For machines having such differences of speed, it is common practice to use either an additional feeder, or a rocking arm which throws the sheet to the final assembly, or pushers mounted on chains. The prior art transfer devices have the drawback of being complex and costly.

One result aimed at by the invention is a process and a transfer device which are simple and guarantee the register in both assemblies. With this in mind, one object of the invention is a transfer process of the type mentioned above, characterized in that:

at least two successive conveyors are coupled which are so chosen that, with equal contact surfaces, the sheet has a coefficient of adhesion which is higher on the second conveyor than on the first and that first, the speed of these conveyors is adapted to that of the sheet as it arrives on the first conveyors, then, when the sheet is disengaged from the assembly which has delivered it to the first conveyor, and it covers the second conveyor with an adequate portion of its length so that the forces of adhesion of said sheet portion on the second conveyor are already higher than those still prevailing on the rest of the sheet on the first conveyor, the speed of the second conveyor is modified until it attains the speed $V_2$ at which the second conveyor is to deliver the sheet, and that finally, as soon as the sheet has left the second conveyor, the speed of the second conveyor is brought back to that of the first so as to permit it to receive a new sheet. Another object of the invention is a device for implementing this process and the machines provided with at least one such transfer device.

The invention will be better understood from the consideration of the ensuing description offered by way of non-limitative example and from the attached drawing representing a side view of the apparatus according to the invention.

Now, referring to the drawing, it is apparent that the apparatus 1 assures the transfer of the sheets 2 coming from a machine 3, on the delivery side of which a belt conveyor or a roller conveyor 4, 5 imparts a specific linear speed $V_1$ thereto, said sheets being transported to a receiver machine 6 on the feed side of which a belt conveyor 7 or a roller conveyor 9, 10 will impart thereto another linear speed resulting, for example, from a difference between the diameters $D_1$, $D_2$ and those of the respective rollers 4, 9, which nevertheless would have to make a complete turn to process the same sheet.

According to a main feature of the process, in order to assure the transfer, at least two successive conveyors 11, 12 disposed between conveyor 4, 5 and conveyor 9, 10 and operatively are coupled which are chosen such that, with equal contact surfaces being equal, the sheet has a coefficient of adhesion which is higher on the second conveyor than on the first, and that first, the speeds of these conveyors are adapted to that of the sheet as it arrives on the first conveyor, and then, when the sheet is disengaged from the assembly that has delivered it to the first conveyor and it covers the second conveyor with an adequate part of its length in order that the forces of adhesion of said sheet portion on the second conveyor are higher than the forces holding the rest of the sheet on the first conveyor, the speed of the second conveyor is modified until it attains the speed $V_2$ at which the second conveyor is to deliver the sheet, and that finally, as soon as the sheet has left the second conveyor, the speed of the second conveyor is brought back to that of the first so as to permit it to receive a new sheet.

It will be understood that because of this, the transfer process according to the invention has the advantage that during the transfer of the sheet the latter adjusts its speed so that it exits from the apparatus 1 at the speed $V_2$ required by the receiver machine, while guaranteeing the exact position of the sheet to obtain register with respect to machines 3 and 6.

The apparatus for implementing this process comprises at least two successive conveyors 11, 12. Preferably, these conveyors consist of endless tapes formed of the belts 13, 14 whose upper side receives the sheet 2 and, in turn, can bear on a table 15, 16. As shown, the conveyors 11, 12 are non-pinching in that they do not pinch the sheets between different elements.

These belts are passed in a manner known from the prior art on motor-driven pulleys 17, 18 and return pulleys 19, 20 to ensure their guidance and drive.

Preferably, the tables 15, 16 consist of the active wall of suction boxes 21, 22 to enable the sheet 2 to be applied on the belts in order to increase their respective forces of adhesion.

According to one feature of the invention, both conveyors have means which, with equal contact surfaces, impart to the second conveyor a force of adhesion on the upper sheet which is higher than that imparted to the first conveyor.

These means may comprise a partial vacuum which is greater in box 22 of the second conveyor 12 than in box 21 of the first conveyor 11, and/or belts which differ in such a way that those of the second conveyor 12 have a greater coefficient of friction than those of the first conveyor 11, for example, on account of the differences of materials and/or conditions of their surface, and at least one of which may be corrugated. Needless to say that the powered pulleys 17, 18 are connected to their motor-driven means 23, 24 by means as known from the prior art.

The apparatus includes a detector 25 for detecting when a sufficient portion or length of the sheet 2 is against the second conveyor 12 so that said portion adheres to the conveyor 12 with a force which is greater than that with which the rest of the sheet still adheres to the first conveyor. In other words, detector 25 detects the position of the sheet.

This detector 25 operates a controller 26 of the speed of the motor-driven means 24 of the second conveyor 12.

Because of the greater adhesion of the second conveyor, it is ensured that during the change of speed the sheet will follow the speed of the second coveyor and will slide onto the first conveyor.

Therefore, the sheet follows a well-defined law of motion in order to obtain register between the machines 3 and 6.

According to one embodiment of the invention, to adapt the speed of the second conveyor at one time to that of the first conveyor 11 and at another time to that at which the second conveyor is to deliver the sheet, the apparatus has coupling devices 27, 28 by means of which, under the action of the controller 26, the motor-driven means 24 is connected sometimes to the motor-driven means 23 controlling the first conveyor, and some-times to the motor-driven means 29 of the receiver machine 6.

When the final assembly 7 has a means 31 which is propelled periodically by the same movement, such as a type plate 31 which carries a counter-form 32 and propelled by an alternate motion beneath a cylinder 9, in one preferred embodiment the second conveyor 12 is connected on one side to the first conveyor 11 by a coupling device with a free wheel which, in the manner of a bicycle wheel, assures the drive of the second conveyor 12 at a speed which is still at least equal to that of the first conveyor without, for all that, preventing its movement at a higher speed and, on the other side, to the type plate by another free wheel which, as soon as the type plate has attained a speed which is higher than that of the first conveyor, takes over the drive to the second conveyor.

We claim:

1. Apparatus for transferring sheets delivered from a delivery assembly, such as a printing or cutting machine, having a specific linear output speed $V_1$, said sheets being conveyed to a receiver assembly to which the sheets are to be delivered at a given linear speed $V_2$ and in register, comprising at least first and second successive conveyors (11, 12) arranged between the delivery assembly and the receiver assembly such that, with equal contact surfaces, a sheet has a coefficient of adhesion which is higher on the second conveyor than on the first conveyor and arranged such that a sheet simultaneously is on both of said first and second conveyors, and means for adjusting the speed of the second conveyor, at one time, to that of the first conveyor and, at another time, to that of the receiver assembly to which the second conveyor delivers the sheet, and further comprising a detector for monitoring the position of a sheet disposed on the second conveyor, a controller responsive to said detector for controlling the speed of the motor-driven means of the second conveyor, and said detector being operatively connected to control said controller to modify the speed of the second conveyor when the adhesion of a sheet to the second conveyor is greater than the adhesion of the sheet to the first conveyor.

2. The apparatus according to claim 1, wherein at least one of the first and second conveyors is adapted to bear on the active face of a suction box forming a table surface disposed beneath the belt.

3. The apparatus according to claim 2 wherein at least one of the belts is a corrugated belt.

4. The apparatus according to claim 1, wherein the first and the second conveyors each include suction boxes, the suction box of the second conveyor producing a greater partial vacuum than the box of the first conveyor.

5. The apparatus according to claim 1 wherein the first and second conveyors are non-pinching.

6. Apparatus for transferring sheets delivered from a delivery assembly, such as a printing or cutting machine, having a specific linear output speed $V_1$, said sheets being conveyed to a receiver assembly to which the sheets are to be delivered at a given linear speed $V_2$ and in register, comprising at least first and second successive conveyors (11, 12) arranged between the delivery assembly and the receiver assembly such that, with equal contact surfaces, a sheet has a coefficient of adhesion which is higher on the second conveyor than on the first conveyor and arranged such that a sheet simultaneously is on both of said first and second conveyors, and means for adjusting the speed of the second conveyor, at one time, to that of the first conveyor and, at another time, to that of the receiver assembly to which the second conveyor delivers the sheet, and further comprising coupling means, connected to be under the action of a controller for connecting a motor-driven means for driving the second conveyor, at one time, to a motor-driven means controlling the first conveyor and, at another time, to a motor-driven means of the receiver assembly.

7. Apparatus for transferring sheets delivered from a delivery assembly, such as a printing or cutting machine, having a specific linear output speed $V_1$, said sheets being conveyed to a receiver assembly to which the sheets are to be delivered at a given linear speed $V_2$ and in register, comprising at least first and second successive conveyors (11, 12) arranged between the delivery assembly and the receiver such that, with equal contact surfaces, a sheet has a coefficient of adhesion which is higher on the second conveyor than on the first conveyor and arranged such that a sheet simultaneously is on both of said first and second conveyors, and means for adjusting the speed of the second conveyor, at one time, to that of the first conveyor and, at another time, to that of the receiver assembly to which the second conveyor delivers the sheet, and wherein the second conveyor is connected to the first conveyor by means of a coupling device having a free wheel which ensures the drive of the second conveyor at a speed which is at least equal to that of the first conveyor without preventing its movement at a higher speed and the second conveyor is connected to a type plate by means of another free wheel which, as soon as the type plate has attained a speed higher than that of the first conveyor, transfers the drive of the second conveyor.

8. A process for transferring a sheet of material from a delivery assembly, such as a printing or cutting machine, to a receiving assembly in register, wherein the delivery of the sheet by the delivery assembly and the reception thereof by the receiving assembly are affected at different speeds, the steps comprising: arranging at least first and second successive conveyors in the path of travel of the sheet and coupling the conveyors such that, with equal contact surfaces, the sheet has a coefficient of adhesion which is higher on the second conveyor than on the first conveyor, delivering the sheet from said delivery assembly via the conveyors to said receiving assembly, first controlling the speed of the conveyors to correspond to that of the sheet as it is delivered from said delivery assembly and arrives on the first conveyor, detecting by a detector when the sheet covers the second conveyor with an adequate part of its length so that forces of adhesion of the sheet part on the second conveyor are higher than those on the rest of the sheet on the first conveyor, and then, modifying the speed of the second conveyor until it attains the speed $V_2$ at which the second conveyor is to deliver the sheet when the sheet is disengaged from the delivery assembly which has delivered it to the first conveyor and the detector indicates that the sheet covers the second conveyor with an adequate part of its length so that the forces of adhesion of the sheet part on the second conveyor are higher that those on the rest of the sheet on the first conveyor, and finally, adjusting the speed of the second conveyor back to that of the first conveyor so as to permit it to receive a new sheet as soon as the sheet has left the second conveyor and has been received by the receiving assembly.

* * * * *